United States Patent [19]

Samuelsen

[11] 4,365,485

[45] Dec. 28, 1982

[54] ARRANGEMENT IN AN ICE MACHINE

[75] Inventor: Per Samuelsen, Grimstad, Norway

[73] Assignee: A/S Finsam International, Inc., N-Oslo, Norway

[21] Appl. No.: 304,956

[22] Filed: Sep. 23, 1981

[30] Foreign Application Priority Data

Oct. 1, 1980 [NO] Norway ..... 802900

[51] Int. Cl.[3] ..... F25C 1/12

[52] U.S. Cl. ..... 62/320; 62/347; 62/352; 209/657

[58] Field of Search ..... 62/320, 347, 66, 348, 62/73, 352, 340; 209/655, 657; 221/212; 222/564; 210/405

[56] References Cited

U.S. PATENT DOCUMENTS

| | | | |
|---|---|---|---|
| 2,524,815 | 10/1950 | Leeson | 62/320 X |
| 2,657,547 | 11/1953 | Heuser | 62/320 X |
| 2,962,869 | 12/1960 | Bartels | 62/320 X |
| 3,190,083 | 6/1965 | Miller | 62/320 X |
| 3,423,952 | 1/1969 | Pugh | 62/347 X |
| 4,107,943 | 8/1978 | Ohling | 62/320 |
| 4,192,151 | 3/1980 | Carpenter | 62/320 |

*Primary Examiner*—William E. Tapolcai
*Attorney, Agent, or Firm*—Watson, Cole, Grindle & Watson

[57] ABSTRACT

In connection with an arrangement in an ice machine which comprises a series of substantially parallel vertically arranged ice freezing elements which during the ice freezing phase are supplied with water, and which are provided with conduits for transport of freezing medium or thawing medium, as well as vessels arranged below the ice freezing elements and adapted for collecting surplus water, and an ice crusher box for crushing and delivery of finished produced ice, there is between the bottom of the ice freezing elements and the collecting vessels for water and the ice crusher box provided a pivotable baffle means which effectively serves to separate ice and water during the various steps of the ice producing process. During the ice freezing phase the baffle means adopts an inclined position which covers the ice collecting vessel, so as to pass the surplus water to the water collecting vessels via a stationary inclined guiding plate having a water pervious field. During the ice harvesting phase when the water supply is shut off, the pivotable baffle means will under the weight of the ice crop be allowed to swing from its inclined basic position to an approximately vertical position and permit the ice flakes to be passed to the ice crusher box, whereafter the pivotable baffle means subsequent to the finished harvesting phase will retain its original inclined position covering the ice crusher box.

8 Claims, 8 Drawing Figures

ARRANGEMENT IN AN ICE MACHINE

BACKGROUND OF THE INVENTION

1. Field of the Invention

The present invention relates to an arrangement in an ice machine comprising a plurality of substantially parallel vertically arranged ice freezing elements which during the ice freezing phase are supplied with water, and which are provided with conduits for transport of freezing medium or thawing medium, as well as vessels arranged below the ice freezing elements and adapted for collecting surplus water, and an ice crusher box for crushing and delivery of finished produced ice.

During the freezing process of such ice machines water is supplied thereto at the top of the vertically arranged ice freezing elements. During this phase the water is allowed to flow or trickle down along the elements whilst a freezing medium is passed through the conduits of the elements. Some of the water flowing along the ice freezing elements will then freeze to ice, whereas surplus water is collected in submounted collection vessels for removal and possibly recirculation thereof. When the ice layer on the ice freezing elements has attained a suitable thickness for example after a predetermined time of freezing operation, the supply of water is terminated and through the conduits of the elements there is then passed a thawing medium, such as vaporized cooling medium having such a pressure as to condense in the conduits. The condensation heat will then heat the elements sufficiently for the inner layer of ice to melt, which entails that the layer of ice will slide down from the ice freezing elements in larger or lesser flakes to be collected in an ice crusher box mounted therebelow. When all the ice has become loose the ice freezing process will be resumed.

In connection with such ice machines it is very important that water and ice are kept apart from each other in the ice machine during the various phases of the ice production process. In other words it is desired that the finished ice is as dry as possible, i.e. as little as possible mixed with water.

2. DESCRIPTION OF THE PRIOR ART

There are previously known ice machines having a longitudinally extending gutter arranged below each plate-shaped ice freezing element and serving to catch and remove water from the lower edges of the ice freezing elements when water during the freezing process flows down along the plates. However, such an arrangement of water catching gutters require gutters having great mechanical strength, said gutters being subjected to shocks and bumps resulting from the loosened ice flakes falling down therebetween. Besides, in most cases there is in the area of each of the gutters a need for a separate conduit for the transport of a medium having a higher temperature than the freezing point of the water, so that a limited ice development on the ice freezing elements in the area of the lower edges thereof is achieved.

Further, there are known ice machines having a plurality of freezing plates which therebelow have arranged an inclined grate-shaped guiding plate which on the one hand serves to let through water during the ice freezing period, and which on the other hand serves to remove finished produced ice during the harvest period. However, such a conventional guiding plate requires large space and will during the freezing period not prevent that water which hits the guiding plate, will splash down in the ice collecting vessel.

SUMMARY OF THE INVENTION

The task underlying the present invention is to give instructions for an improved ice machine in which the above mentioned disadvantages are removed. In other words the aim is to the effect of providing an arrangement in an ice machine which aside from making the design of the machine simpler will also improve the separation of ice and water.

The problem is solved by an ice machine of the type stated in the preamble which according to the invention is characterized in that between the bottom of the ice freezing elements and the water collecting vessels and the ice crusher box there is provided a pivotable baffle means which during the ice freezing phase adopts an inclined position covering the ice crusher box and conducting the surplus water to the water collecting vessels via a stationarily arranged inclined guiding plate having a water escaping field, and which during the ice harvesting phase when the water supply is shut off can swing to an approximately vertical position under the weight of the ice crop and enable the ice flakes to be passed to the ice crusher box, the pivotable baffle means subsequent to the finished harvesting phase retaining its inclined position covering the ice crusher box.

By such an arrangement there is no need for heating the lower portions of the ice freezing elements because the water collecting gutters can be dispensed with in the area thereof. In other words the ice can freezeze around the end portions of the ice freezing elements, a fact which entails improved machine capacity.

Further, the arrangement according to the invention allows for a better separation of ice and water because the pivotable baffle means automatically adopts a position which prevents water from splashing or flowing down into the ice crusher boxes.

For further prevention of water splashing into the area of the ice crusher box the pivotable baffle means is along the lower edge thereof suitably provided with a resilient field which shields the spray of water but allows the passing of relatively small ice bits. Preferably, the resilient field may be constituted by a brush-like means which in turn can be replaceable.

In connection with an ice machine comprising a plurality of substantially vertically arranged plate-shaped ice freezing elements the pivotable baffle means can suitably take the form of a bent plate having two inclined baffle portions and being pivotably supported on a shaft extending along the bending line of the plate, the pivoting shaft being arranged in the middle area below the ice freezing plates. Such a design of the pivotable baffle means allows for a rational rotation operation of the ice freezing plates, i.e. involving that one set of plates which is arranged above the first baffle portion is used for the production of ice whereas the other set of plates which is arranged above the second baffle portion, is simultaneously in the ice harvesting phase, and vice versa.

Preferably, the inclined baffle plates comprise a water escaping portion which is built up from two sets of parallel grate forming ribs, the end portions of the one set of ribs adopting therebetween the end portions of the other set of ribs for thereby forming an interchanging field. Such an interchanging field entails that the water which is to pass the field, will be retarded at the same time as it will be forced to change direction. The result is that the water with larger security will leave the guiding plates in the area of the escape portion and thus not reach the area of the ice crusher box.

As a thawing medium there is used a vaporized cooling medium, also called warm gas, which is supplied from the compressor to a warm gas distributor which preferably has a pear-shaped cavity which at the narrowest portion thereof is connected to the supply conduit for warm gas, and which at its opposite end is provided with a number of outlet openings corresponding to the number of ice freezing elements, the cross section of the supply portion having an area corresponding to the areas of the outlet openings. Such a hot gas distributor distributes the warm gas to the freezing elements very equally and with a minimum reduction in pressure. The result is shorter thawing time and reduced energy consumption per produced ice unit.

In the following the invention will be further described, reference being had to the drawing which illustrates embodiments of the arrangement according to the invention.

DESCRIPTION OF PREFERRED EMBODIMENTS

Figure 1:
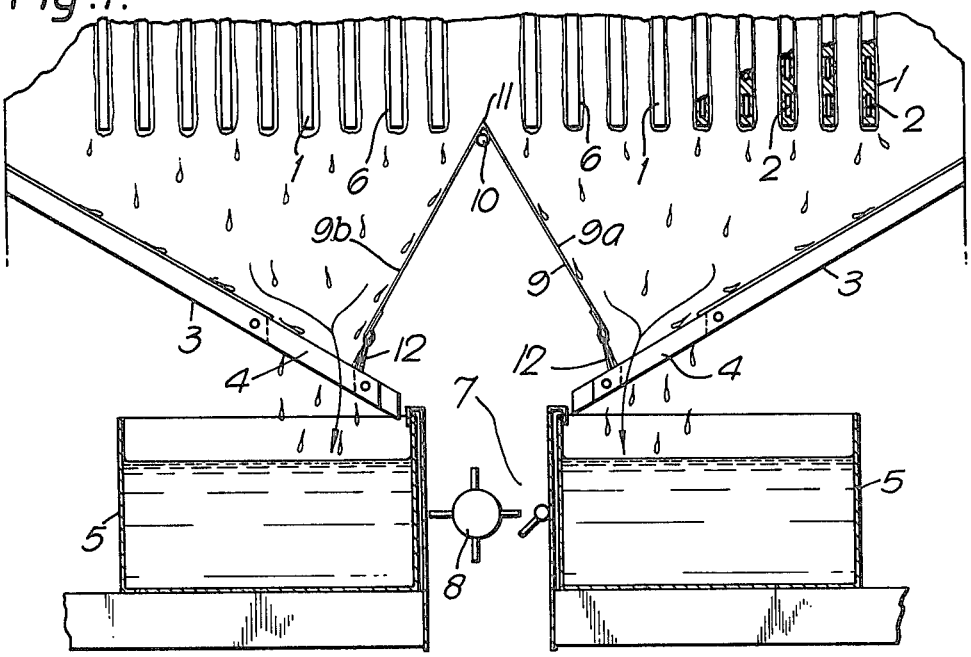
FIG. 1 is a diagrammatical end view partly in section of a sector of an ice machine comprising an embodiment of the arrangement according to the invention.
Figure 2:
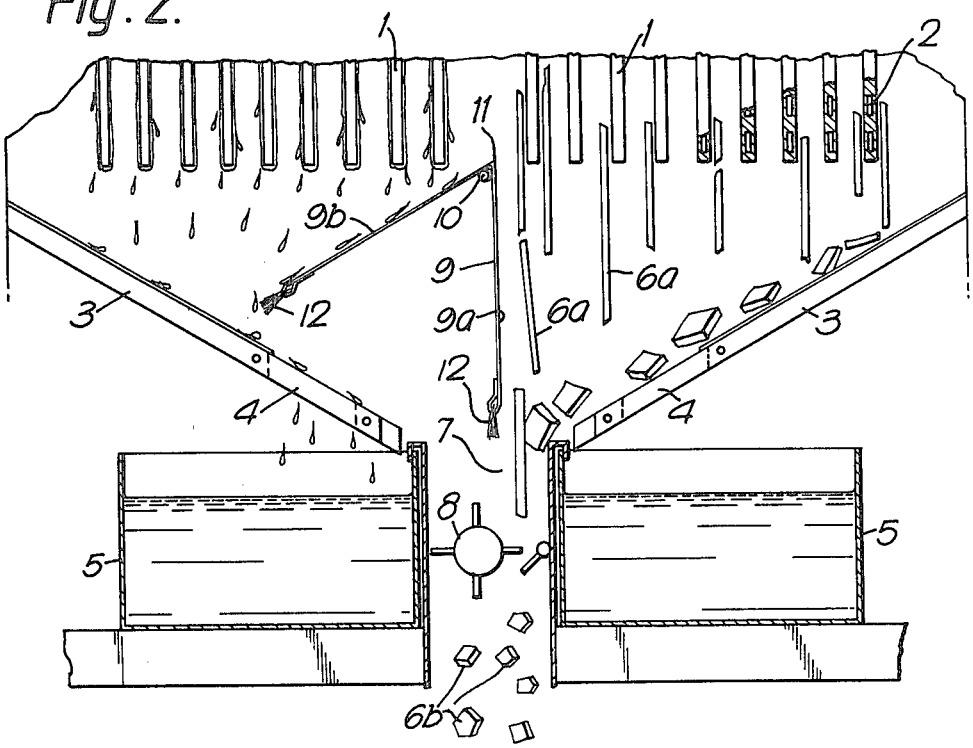
FIG. 2 is a diagrammatic end view similar to FIG. 1, but illustrates the pivotable baffle means in influenced position during an ice harvesting phase.
Figure 3:
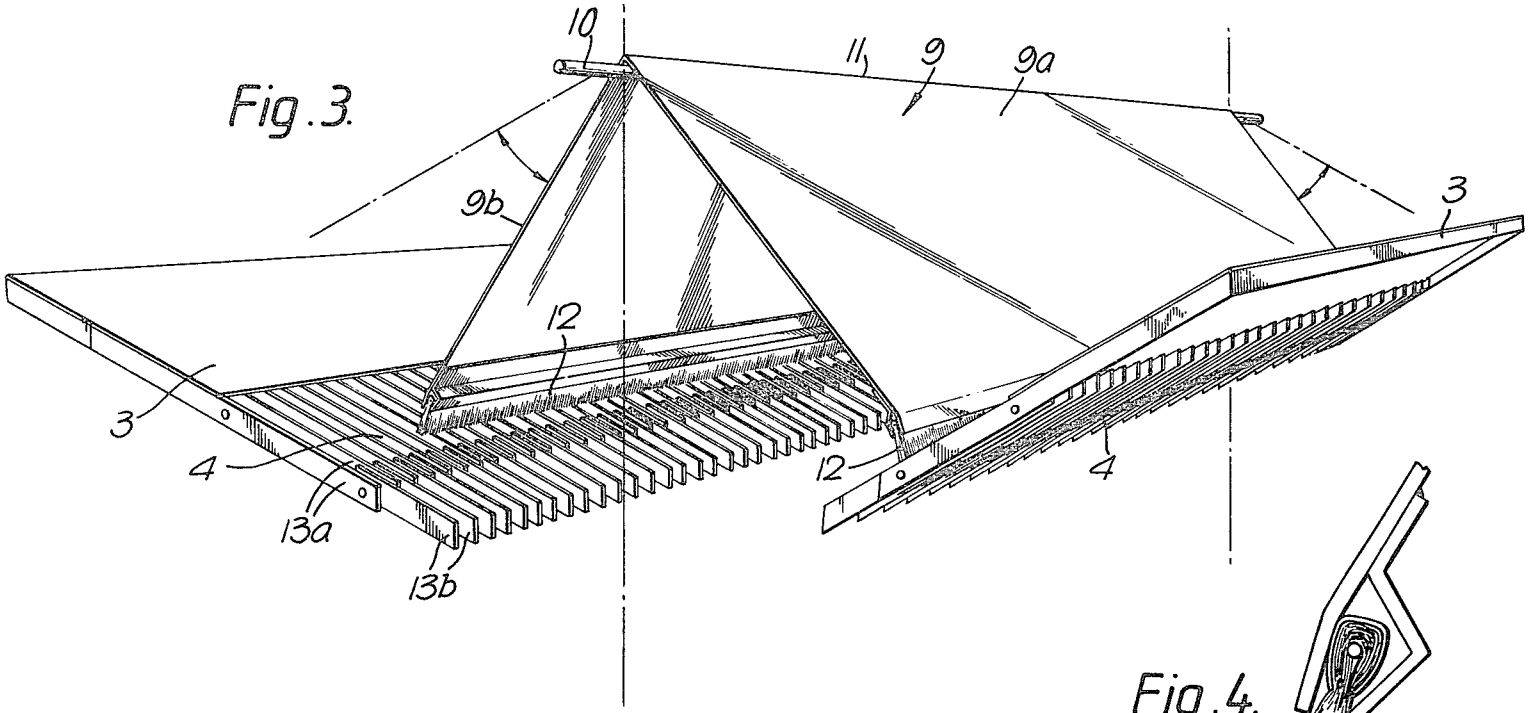
FIG. 3 is a perspective view of a second embodiment of the arrangement according to the invention.

In FIGS. 1, 2 and 3 which illustrate diagrammatic side views and a perspective view, respectively, of an arrangement according to the invention, 1 designates a series of substantially parallel vertically arranged plate-shaped ice freezing elements which during the ice freezing phase are supplied with water at the top thereof. The water is allowed to flow or trickle down along the elements 1, a freezing medium being passed through longitudinally extending horizontal conduits 2 in the ice freezing elements. Some of the water which flows along the ice freezing elements 1, will then freeze to ice, whereas surplus water falls down on a guiding plate 3 having a water pervious portion 4, the water after having passed therethrough being collected in water collecting vessels 5. The surplus of water can either be removed or possibly be recirculated for renewed supply to the machine at the top of the ice freezing elements 1.

When the ice layer on the elements 1 has reached an appropriate thickness, the water supply is stopped and through the conduits 2 in the elements 1 there will then be passed a thawing medium, usually vaporized cooling medium or so-called warm gas which dissipates sufficient heat for melting the inner film of the ice layer which in FIGS. 1 and 2 is designated 6. This entails that the ice layer, as it is indicated more clearly in FIG. 2, will tumble down from the ice freezing elements 1 in larger or lesser flakes 6*a* for along the guiding plates 3 to be passed to an ice crusher box 7, in which is mounted a rotatable longitudinally extending crusher 8 which crushes the ice flakes 6*a* to ice pieces 6*b* of suitable size.

Between the bottom of the ice freezing elements 1 and the water collecting vessels 5 or the ice crusher box 7 there is provided a pivotable baffle means which is generally designated by 9, and which in the disclosed embodiment takes the form of a bent plate including two inclined baffle portions 9*a* and 9*b*, respectively. The baffle means 9 is pivotably supported on a shaft 10 which extends along the bending line 11 of the plate, the pivoting shaft 10 being located in the middle area below the ice freezing elements 1.

During the ice freezing phase the pivotable baffle means 9 adopt such a position that the inclined baffle portions 9*a* and 9*b* cover the ice crusher box 7 and pass the surplus water to the water collection vessels 5 via the stationarily arranged inclined guiding plates 3 equipped with the water pervious fields 4. Such a freezing phase is depicted in FIG. 1.

In FIG. 2 there is illustrated a position of the pivotable baffle means 9 during an ice harvesting phase. It is to be understood that the ice harvesting phase only takes place for that half of the ice freezing elements 1 which is arranged to the one side of the middle of the machine or to the one side of the pivoting shaft 10, whereas the harvesting for the set of ice freezing plates which is arranged on the other side of the pivoting shaft will be carried out at a different point of time, that is when the harvesting phase of the first set is terminated.

As illustrated in FIG. 2 the pivotable baffle means will during the ice harvesting phase when the supply of water is shut off, under the weight of the ice which is harvested, i.e. under the influence of the avalanching ice flakes 6*a*, permit that the baffle portion 9*a* in question will pivot from an inclined ice crusher box covering position to an approximately vertical position which permits the ice flakes 6*a* to be passed to the ice crusher box 7 for the crushing therein to ice pieces 6*b*. After the termination of the ice harvesting phase of the plate set in question the pivotable baffle means 9 will resume the original ice crusher box covering position illustrated in FIG. 1 and FIG. 3.

Figure 4:
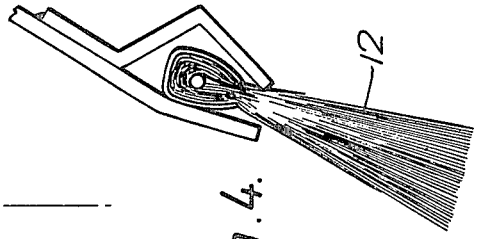
FIG. 4 illustrates on a larger scale a detail of the arrangement according to the invention.

As appearing from FIGS. 1 and 2 and especially from FIGS. 3 and 4 the pivotable baffle means 9 is along the lower edges thereof equipped with a resilient field 12, the task of which is to block the spray of water which develops on the guiding plates during the ice freezing phase. However, the field 12 allows for the by-pass of the relatively small ice bits which appear at the end of a harvesting period and which in themselves are not heavy enough to pivot the baffle means out of its basic position.

In the illustrated embodiment the resilient field 12 is constituted by replaceable brushes and will in the basic position of the baffle means 9 be positioned in the area of the water pervious field 4 of the guiding plate 3.

Figure 6:
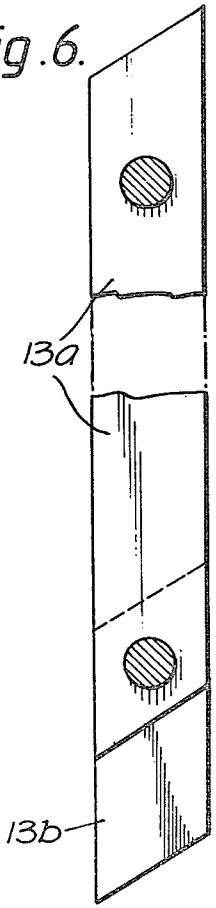
FIG. 6 is a section taken along the line VI—VI in FIG. 5.
Figure 5:
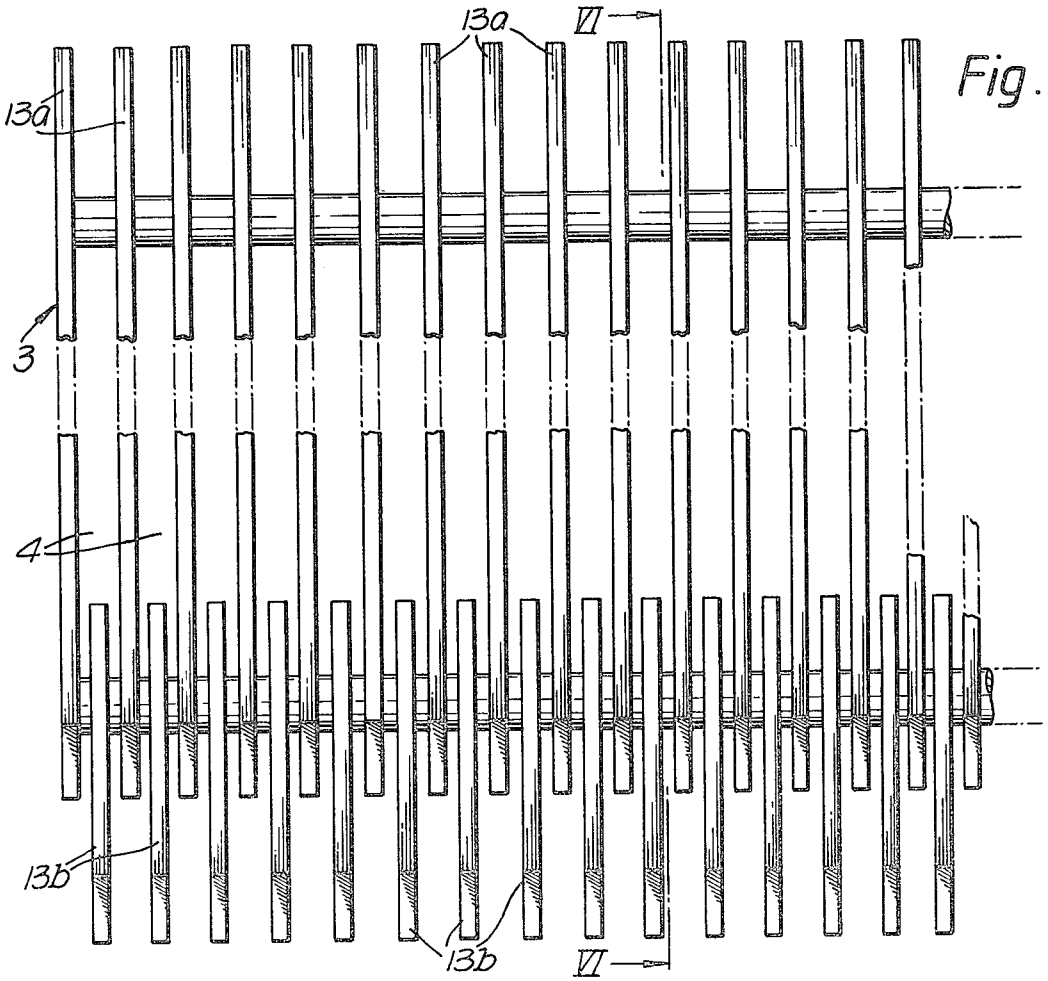
FIG. 5 illustrates on a larger scale an ambodiment of a water escaping portion of a guiding plate.

The permanently arranged inclined guiding plates 3 have a water pervious portion 4 which suitably is constructed from two sets of parallel grate-forming ribs as this appears from FIGS. 3, 5 and 6, the end portions of the one set of ribs 13*a* adopting therebetween the end portions of the other set of ribs 13*b*. The grate portion which is assembled from the set of ribs 13*a* and 13*b* gives an interchanging portion which reduces the speed of the water so that it can have more time to flow down between the ribs, the interchanging portion also forcing the water to change direction. As a result such an interchanging portion will give a great security for the water really dropping down from the grate area and being caught by the water collecting vessels therebelow.

Figure 7:
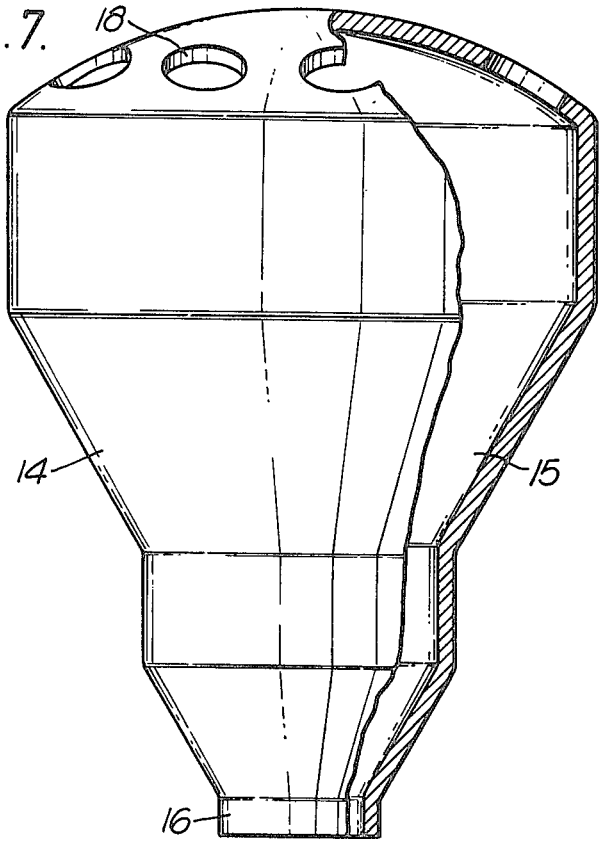
FIGS. 7 and 8 include a side view partly in section and a plan view, respectively, of an embodiment of a warm gas distributor.
Figure 8:
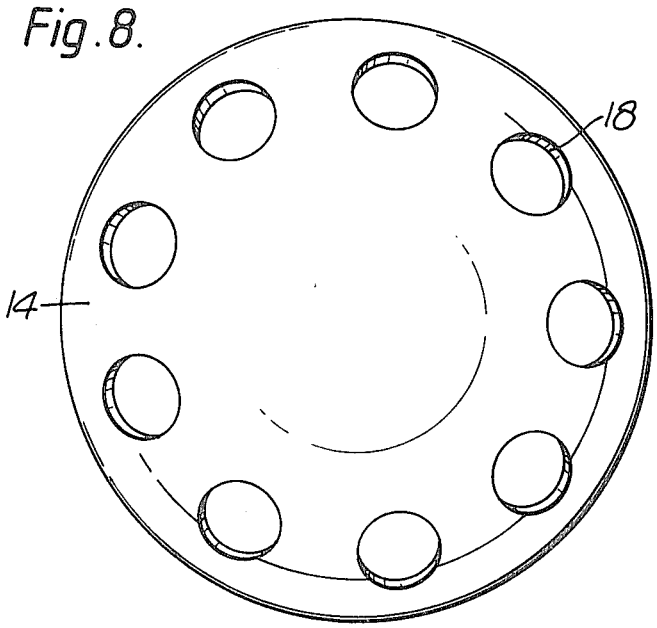

In order to further increase the capacity of the ice machine there is for the distribution of warm gas from the compressor to the conduits 2 in the ice freezing elements 1 used a warm gas distributor of the type which is illustrated in FIGS. 7 and 8. The warm gas distributor is here designated by 14 and has a pear-shaped cavity 15 which at the narrowest portion 16 thereof is connected to a supply conduit for warm gas, and which at its opposite end is equipped with for example nine outlet openings 18 corresponding to the number of ice freezing elements constituting one half of the ice machine. The cross section of the supply portion 16 has an area corresponding to the sum of the areas of the outlet openings 18, a fact which involves a minimum reduction in pressure for the warm gas which flows through the warm gas distributor and thus a very equal distribution of hot gas to the ice freezing elements in question during the ice havesting phase.

An ice machine which is equipped with an arrangement of the above described type excels in its simple construction and its larger capacity compared with previously known ice machines. The ice freezing elements can be given simple geometric shapes, especially in the bottom portion and it is allowed that the ice can freeze therearound. Roundabout freezing at the plate bottoms involves larger freezing capacity which together with the deletion of water gutters below each separate freezing element and thereby bottom heating entails reduced energy per unit produced ice.

The arrangement according to the invention also renders a better separation of ice and water, the pivotable baffle means automatically adopting the most favourable position whether there is carried out an ice freezing or ice harvesting cyclus.

It is to be understood that the illustrated embodiment of a pivotable baffle means is especially suitable in connection with ice machines having divided operation, i.e. in which the ice freezing elements are divided in two sets which alternate between ice freezing and ice harvesting, the warm gas from the common compressor being used for the ice harvesting phase for the one set when the other set of ice freezing elements is used for ice production.

However, it is to be understood that the pivotable baffle means can adopt other shapes than what has been described above. For example the baffle means can be equipped with only one baffle portion which is arranged under the ice freezing elements in a first ice machine, whereas a corresponding baffle means is arranged below the ice freezing elements in a second ice machine. Preferably these ice machines can work in a rotation mode, so that dissipated heat from the compressor in a first machine can be utilized for ice harvesting in a second ice machine during the period in which the first ice machine is used for ice production.

Further, it is to be understood that along its lower edges the pivotable baffle means can be provided with other resilient fields that the brush-like fields which is described above. For example, there can be used a flexible cloth or web which meet the same requirements for rejecting the water and letting the ice bits through.

What I claim is:

1. Arrangement in an ice machine comprising a plurality of substantially parallel vertically arranged ice freezing elements (1) which during the ice freezing phase are supplied with water, and which are provided with conduits (2) for transport of freezing medium or thawing medium, as well as vessels (5) arranged below the ice freezing elements and adapted for collecting surplus water, and an ice crusher box (7) for crushing and delivery of finished produced ice (*6b*), characterized in that between the bottom of the ice freezing elements (1) and the water collecting vessels (5) and the ice crusher box (7) there is provided a pivotable baffle means (9) which during the ice freezing phase (FIG. 1) adopts an inclined position covering the ice crusher box (7) and conducting surplus water to the water collecting vessels (5) via a stationarily arranged inclined guiding plate (3) having a water escaping field (4), and which during the harvesting phase (FIG. 2) when the water supply is shut off can swing to an approximately vertical position under the weight of the ice crop (*6a*) and enable the ice flakes (*6a*) to be passed to the ice crusher box (7), the pivotable baffle means (9) subsequent to the finished harvesting phase retaining its inclined position covering the ice crusher box.

2. Arrangement as claimed in claim 1, characterized in that the pivotable baffle means (9) takes the form of a bent plate having two inclined baffle portions (*9a, 9b*) and is pivotably supported on a shaft (10) extending along the bending line (11) of the plate, the pivoting shaft (10) being arranged in the middle area below the ice freezing elements (1).

3. Arrangement as claimed in claim 1 or 2, characterized in that at its lower edge the pivotable baffle means is equipped with a resilient field (12) which blocks the spray of water but allows the by-passing of relatively small ice bits.

4. Arrangement as claimed in claim 3, characterized in that the resilient field (12) is constituted by a brush-like means.

5. Arrangement as claimed in claim 1, characterized in that the permanently arranged inclined guiding plates (3) comprise a water pervious portion (4) which is constructed from two sets of parallel grate-forming ribs, the end portion of the one set of ribs (*13a*) adopting therebetween the end portions of the other set of ribs (*13b*) for the provision of an interchanging field.

6. Arrangement as claimed in claim 2, characterized in that the pivotable baffle means (9) during the ice freezing phase (FIG. 1) has its inclined baffle portion or portions (*9a, 9b*) extending obliquely down towards the interchanging field (4) of the guiding plates.

7. Arrangement as claimed in claim 2, characterized in that the bent baffle plate (9) with the two baffle portions (*9a, 9b*) is utilized in connection with an ice machine in which the thawing of the ice freezing elements alternate between two sets of ice freezing elements, the ice crop from the first set swinging the baffle means to a position in which the first baffle portion adopts an approximately vertical position permitting the ice to be passed to the ice crusher box at the same time as the water from the other set in which ice freezing takes place, is prevented from flowing down into the ice crusher box because the other baffle portion (*9b*) is swung further into the area of the other set of plates, and vice versa during rotation operation.

8. Arrangement as claimed in claim 1, characterized in that for the distribution of warm gas from a compressor there is utilized a warm gas distributor (14) which comprises a pear-shaped cavity (15) which at the narrowest portion thereof, the supply portion (16), is connected to a supply conduit for warm gas, and which at the opposite end is provided with a number of outlet openings (18) corresponding to the number of ice freezing plates the cross-section of the supply portion (16) having an area corresponding to the sum of areas of the outlet openings (18).

* * * * *